US005464161A

United States Patent [19]

Upton, III et al.

[11] Patent Number: 5,464,161

[45] Date of Patent: Nov. 7, 1995

[54] SOLID WASTE PULPER

[75] Inventors: William K. Upton, III, Chester, Md.; William E. Schneider, White Pine, Tenn.; Stuart H. Brown, Severna Park, Md.; Steven A. Stetz, Stevensville, Md.; Emily J. Gotich, Crofton, Md.; Jack L. McCrea, Pittsburgh, Pa.

[73] Assignee: The United States of America as represented by the Secretary of the Navy, Washington, D.C.

[21] Appl. No.: 312,950

[22] Filed: Sep. 30, 1994

[51] Int. Cl.[6] ..... B02C 18/40

[52] U.S. Cl. ..... 241/21; 241/24; 241/46.17; 241/46.11

[58] Field of Search ..... 241/46.06, 46.11, 241/46.17, 21, 24, 79, 235

[56] References Cited

U.S. PATENT DOCUMENTS

| | | | |
|---|---|---|---|
| 3,188,942 | 6/1965 | Wandel | 241/46.06 X |
| 3,584,800 | 6/1971 | Dodd et al. | 241/46.06 |
| 3,599,881 | 8/1971 | Craig et al. | 241/46.06 |
| 5,377,918 | 1/1995 | Pastor et al. | 241/46.17 |

FOREIGN PATENT DOCUMENTS

| | | | |
|---|---|---|---|
| 244492 | 11/1962 | Australia | 241/46.06 |

*Primary Examiner*—Timothy V. Eley
*Assistant Examiner*—John M. Husar
*Attorney, Agent, or Firm*—Gary G. Borda

[57] ABSTRACT

A solid waste pulper including a pulping chamber, oriented at an angle, having a first inlet port for introducing solid waste material to be pulped, and a second inlet port in the pulping chamber for introducing water into the chamber. A blade assembly, preferably formed of a plurality of rotatable blades and a plurality of fixed blades, is mounted in the chamber for pulping the solid waste material introduced in the chamber, the water mixing with the pulped waste material to form a slurry. A sizing ring is provided in the pulping chamber through which the slurry must pass to be discharged, the sizing ring having a predetermined area for limiting the size of the pulped waste material in the slurry which can be discharged from the pulping chamber. The pulper also includes a discharge port coupled to the pulping chamber for discharging the slurry containing the pulped waste material, the discharge port having a predetermined cross-sectional area which is smaller than the area of the sizing ring, thus limiting the maximum flow of slurry discharged from the pulping chamber.

11 Claims, 1 Drawing Sheet

SOLID WASTE PULPER

This invention was made with Government support by the Naval Surface Warfare Center. The Government has certain rights in this invention.

BACKGROUND OF THE INVENTION

1. Field of the Invention

The present invention relates to solid waste pulpers and, more particularly, to a solid waste pulper with an improved structure for controlling the solid waste processing rate.

2. Description of the Related Art

Solid waste pulpers are used to process cellulose-based and food waste products into small particles that, when combined with water, form a pumpable slurry. Pulping or processing is accomplished by feeding the waste products and water into a chamber containing electric motor driven rotating blades and fixed blades and passing the processed material through a particle sizing device. The ratio of solid waste to water must be kept below 2% solids by weight to ensure pumpability, and solid particle sizes must be kept small (small enough to pass through ¼" holes).

Prior methods of controlling the solid waste processing rate relied upon controlling the water level in the tank within a very narrow range by one of two methods, as described below.

The first method, which can only be used for small units, employs a weir or standpipe to maintain water level and minimizes the feed rate with a restricted feed port. This adds size and weight to the machine and can cause discharge line clogs if trash is fed too fast or if pulp collects in the weir.

The second method, which is used for large pulpers or for units that require pumping, uses a centrifugal type pump to discharge the slurry and maintains water level by using a level sensing device to periodically add surplus water to the tank when the water level reaches a low set-point. This second method does not use a restricted feed port, but relies on measurement of the draw of electric motor current to provide feedback to the operator if trash is fed too fast. Level sensing devices are not reliable for this process because of several factors including vortex dynamics, fouling of sensor ports with pulp, and vibration. The feed rate control method is not sufficiently responsive to prevent slurry concentrations from exceeding pulpable levels (2% solids by weight, maximum) since sudden increases in feed rate result in water feed being reduced and the pump will, if starved, pull unpulped material through the particle sizing devices.

The above described prior art methods are particularly disadvantageous because the processing rate of the pulper is limited by restrictions on the solid waste feed and the discharge flow rate.

SUMMARY OF THE INVENTION

The present invention overcomes the above-noted disadvantages of the prior art by providing a pulper in which the processing rate can be maximized because it does not require restrictions of either the solid waste feed or the discharge flow rate.

In the present invention, inlet water is added at a constant rate to the pulping chamber and discharged by gravity. As the feed rate of pulpable material increases, the water level rises, thus providing a responsive and reliable indicator of feed rate control. Pumping is accomplished preferably by using an eductor with a vented suction (so that suction is not applied to the pulper discharge) or, alternatively by a pump with a vented mixing chamber on its inlet that provides additional water so that the pump suction is not starved.

Specifically, the solid waste pulper of the present invention includes a pulping chamber, oriented with its centerline at a non-vertical angle, having a first inlet port for introducing solid waste material to be pulped, and a second inlet port in the pulping chamber for introducing water into the chamber. A blade assembly, preferably formed of a plurality of rotatable blades and a plurality of fixed blades, is mounted in the chamber for pulping the solid waste material introduced in the chamber, the water mixing with the pulped waste material to form a slurry.

A particle size control device is provided in the pulping chamber through which the slurry must pass to be discharged, the particle size control device having a predetermined area and hole geometry for limiting the particle size of the pulped waste material in the slurry that is discharged from the pulping chamber.

The pulper also includes a discharge port coupled to the pulping chamber for discharging the slurry containing the pulped waste material, the discharge port having a predetermined cross-sectional area and hole geometry which is smaller than that of the particle size control device, thus limiting the maximum flow of slurry discharged from the pulping chamber.

In the preferred embodiment of the invention, the particle size control device is a sizing ring having a plurality of nominal ¼" inner diameter apertures through which the slurry passes to reach the discharge port.

A vortex guide vane is mounted in the pulping chamber for controlling the geometry of the slurry in the chamber to achieve optimal pulping.

The present invention combines the actions of the rotating blade, the sizing ring, the discharge port and the pulping chamber vortex guide vane to control the throughput flow rate of the machine.

The new method of pulping with the apparatus of the present invention eliminates the use of level control devices and permits unrestricted direct gravity discharge. The sizing ring limits the size of the slurry particles that are permitted to exit the machine and also plays a large part in the control of material and flow processing rate through the machine.

Other features and advantages of the present invention will become apparent from the following description of the invention which refers to the accompanying drawings.

DETAILED DESCRIPTION OF THE PREFERRED EMBODIMENT

Figure 1:
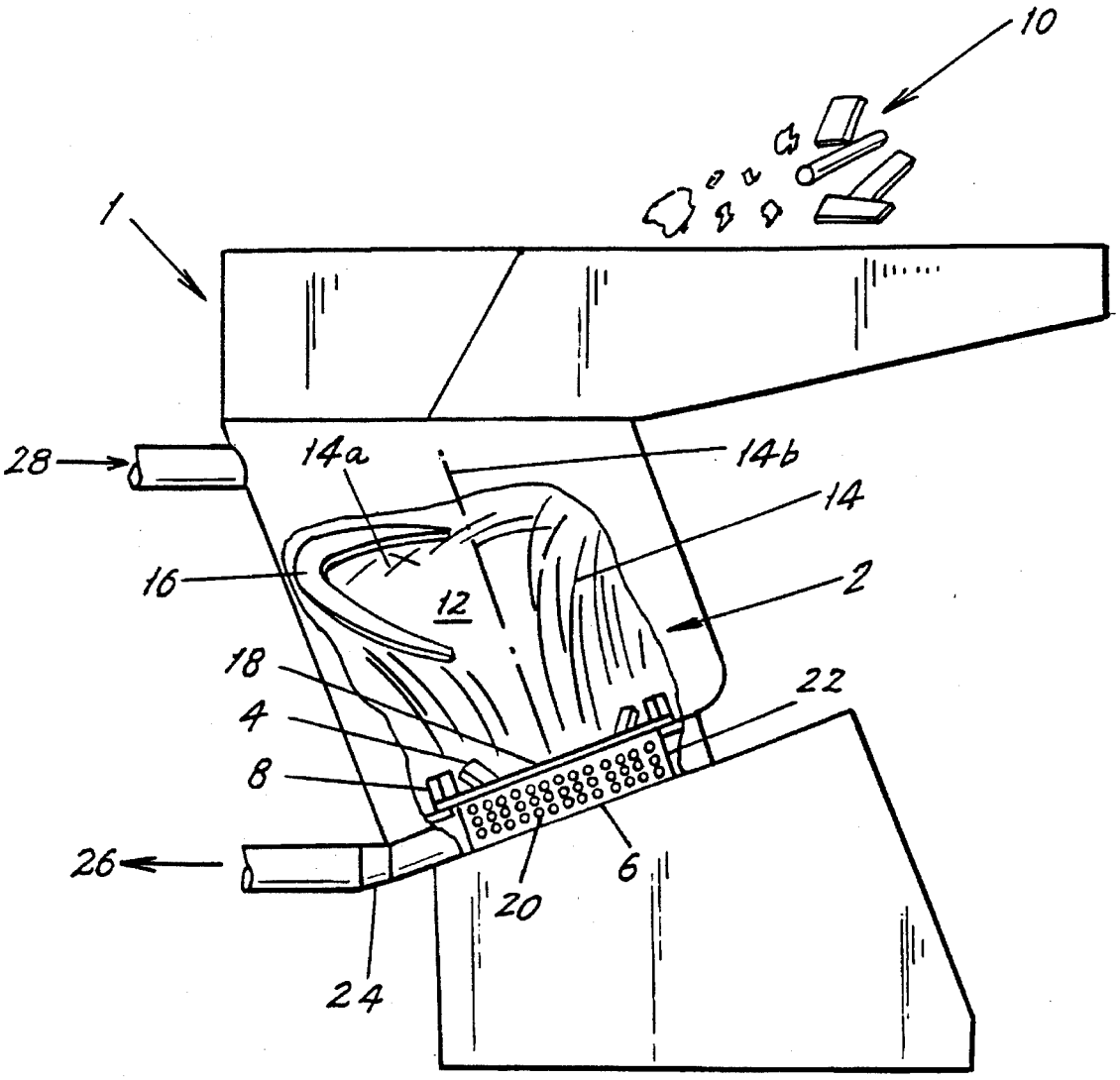
Fig. 1 shows the pulper of the present invention, including the structure for controlling the processing rate of the pulper.

Referring to FIG. 1, a solid waste pulper 1 is shown which includes a pulping chamber 2 containing a plurality of rotating blades 4 mounted on an impeller 6. A plurality of stationary or fixed blades 8 are arranged concentrically adjacent to rotating blades 4 such that, upon rotation of impeller 6, rotating blades 4 pass closely by fixed blades 8. Any waste material 10 which passes through rotating blades 4 and fixed blades 8 is pulped into small particles which, when combined with water, form a slurry 12.

The level of slurry 12 in the pulping chamber 2 forms a vortex 14, which is created by the rotating impeller 6 and blades 4. The pulping chamber 2 is arranged at a tilt angle as shown in Fig. 1 to aid in the settling out of heavy non-pulpable materials away from the pulping mechanism. A crescent-shaped metal vortex guide vane 16 is provided within chamber 2 to limit the level of slurry 12 on the low side of the tilted chamber 2, and also to fold the outer edge of the vortex 14*a* back towards its axis 14*b*. This increases the pulping action and ultimately increases the processing rate.

Before it can exit chamber 2, slurry 12 must pass through a particle size control device in the form of a sizing ring 18. Sizing ring 18 contains holes 20 that limit the size of the waste particles in slurry 12 exiting chamber 2. The number and the size of the sizing ring holes 20 provides the primary control at which the waste 10 is processed in the present invention. Although round holes are most appropriate for slurry particle sizing, various other shaped holes or slots can be used in the sizing ring.

After passing through the sizing ring 18, the slurry 12 enters a collection chamber 22 and passes through the discharge port 24 of the machine and into the discharge line 26. The cross-sectional area of discharge port 24 is smaller than that of the total area of the holes 20 in sizing ring 18. Thus, discharge port 24 acts as a secondary control of the processing rate; i.e., it limits the maximum flow of slurry that can pass through the pulper 2. Discharge port 24 need not be built into the machine. For example, the discharge port can be a nozzle-shaped transition piece between the machine and discharge piping. Although less satisfactory, an orifice can also be used to serve this control function.

Water is fed into chamber 2 through a water supply line 28. The inlet flow of water in the present invention is set at a fixed rate (in contrast to the prior art pulping methods), and the hand feed rate of waste 10 is controlled by the machine operator. The processing rate of the pulper of the present invention advantageously responds automatically to the feed rate and waste type by allowing the water level to rise in the tank, thus increasing waste holding time. In the prior art pulping machines, the converse is required; i.e., the operator must adjust the feed rate to respond to changes in the processing rate and waste type, since a constant water level must be maintained.

The waste processing control apparatus of the present invention has other important advantages over prior art machines. It does not have external level control mechanisms that add weight or complexity and lower reliability. In addition, it offers the potential to achieve higher processing rates for a given size machine (achieved for example by adding more cutting surfaces or increasing impeller speed) because it does not require restriction of either the solid waste feed or the discharge flow rate.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A solid waste pulper for processing waste at a processing rate, comprising:

a pulping chamber, said pulping chamber being tilted so as to have a non-vertical centerline wherein said tilt creates a low side of said pulping chamber;

a first inlet port in said pulping chamber for introducing solid waste material to be pulped;

a blade assembly mounted in said pulping chamber for pulping the solid waste material introduced in said pulping chamber;

a second inlet port in said pulping chamber for introducing water into said pulping chamber, the water mixing with the pulped waste material to form a slurry;

a particle size control device in said pulping chamber through which the slurry must pass to be discharged from said pulping chamber, said control device functioning to limit the size of the pulped waste material in the slurry which is discharged by gravity from said pulping chamber, said control device further having a first predetermined area through which the slurry must pass, said first predetermined area providing a first means to control said processing rate; and a discharge port coupled to said pulping chamber for discharging the slurry containing the pulped waste material, said discharge port having a cross-section of a second predetermined area for limiting the maximum flow of slurry discharged from said pulping chamber, said second predetermined area of said discharge port is smaller than said first predetermined area of said particle size control device wherein said discharge port provides a second means to control said processing rate.

2. The solid waste pulper of claim 1, further comprising a crescent shaped vortex guide vane mounted in said pulping chamber for controlling the geometry of the slurry in said pulping chamber, said vortex guide vane functioning to limit the level of the slurry on said low side of said pulping chamber.

3. The solid waste pulper of claim 1, wherein said blade assembly comprises a plurality of rotatable blades and a plurality of fixed blades.

4. The solid waste pulper of claim 3, further comprising an electric-motor driven rotatable impeller, said rotatable blades being mounted on said impeller.

5. The solid waste pulper of claim 1, wherein said particle size control device comprises a sizing ring having a plurality of apertures through which the slurry passes to reach said discharge port, said apertures having individual areas which function to limit the size of the pulped waste material in the slurry and further wherein said individual areas collectively form said first predetermined area.

6. The solid waste pulper of claim 5, wherein said apertures of said sizing ring are round.

7. A method for pulping solid waste material at a processing rate, comprising:

orienting a pulping chamber such that a centerline of said pulping chamber is disposed at a non-vertical angle;

introducing said solid waste material to be pulped into said pulping chamber;

pulping said solid waste material introduced into said pulping chamber with a blade assembly mounted in said pulping chamber, said blade assembly comprising a plurality of rotatable blades and a plurality of fixed blades, said rotatable blades being mounted on an impeller in said pulping chamber;

introducing water into said pulping chamber at a predetermined constant flow rate, said water mixing with said pulped waste material to form a slurry;

passing said slurry through a particle size control device in said pulping chamber, said particle size control device functioning to limit the size of said pulped waste material in said slurry which can be discharged from said pulping chamber, said control device further having a first predetermined area through which said slurry passes, said first predetermined area providing a first means to control said processing rate; and discharging said slurry containing said pulped waste material through a discharge port, said discharge port having a cross-section of a second predetermined area for limiting the maximum flow of said slurry discharged from said pulping chamber, wherein said discharge port provides a second means to control said processing rate.

8. The method for pulping solid waste material as recited in claim 7, wherein said second predetermined area is smaller than said first predetermined area, such that said discharge port sets a maximum limit on the amount of said slurry that can pass through said pulper.

9. The method for pulping solid waste material as recited in claim 8, further comprising the step of controlling the geometry of said slurry with a crescent shaped vortex guide vane disposed in said pulping chamber.

10. The method for pulping solid waste material as recited in claim 8, wherein said slurry in said pulping chamber has a level which rises as said solid waste material to be pulped is introduced into said pulping chamber, said rising slurry level in said pulping chamber providing a means for indicating a maximum rate at which said solid waste material can be introduced into said pulping chamber.

11. The method for pulping solid waste material as recited in claim 8, wherein said particle size control device includes a plurality of apertures through which said slurry passes to reach said discharge port, said apertures having individual areas which function to limit the size of the pulped waste material in said slurry and further wherein said individual areas collectively comprise said first predetermined area, said apertures preventing discharge of said slurry above an acceptable size by slowing discharge of said slurry to a rate below the rate at which water is being introduced into said pulping chamber, thereby diluting said slurry to an acceptable solids concentration.

* * * * *